US006494565B1

(12) United States Patent
Ellson et al.

(10) Patent No.: US 6,494,565 B1
(45) Date of Patent: Dec. 17, 2002

(54) METHODS AND APPARATUSES FOR OPERATING A VARIABLE IMPEDANCE ACOUSTIC INK PRINTHEAD

(75) Inventors: Richard N. Ellson, Palo Alto; Robert P. Kowalski, Campbell; Babur Hadimioglu, Mountainview; Thanh Duc Truong, Walnut, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/434,981

(22) Filed: Nov. 5, 1999

(51) Int. Cl.[7] ..... B41J 2/135
(52) U.S. Cl. ..... 347/46
(58) Field of Search ..... 347/46, 44, 20, 347/5, 9, 10, 12, 13, 188, 37, 40, 41, 43, 17

(56) References Cited

U.S. PATENT DOCUMENTS

| | | | | |
|---|---|---|---|---|
| 4,540,991 A | * | 9/1985 | Kariya et al. | 347/191 |
| 4,697,195 A | | 9/1987 | Quate et al. | 347/46 |
| 4,751,530 A | | 6/1988 | Elrod et al. | 347/46 |
| 4,751,534 A | | 6/1988 | Elrod et al. | 347/46 |
| 4,782,350 A | | 11/1988 | Smith et al. | 347/43 |
| 4,797,693 A | | 1/1989 | Quate | 347/46 |
| 5,041,849 A | | 8/1991 | Quate et al. | 347/46 |
| 5,229,793 A | | 7/1993 | Hadimioglu et al. | 347/46 |
| 5,268,610 A | | 12/1993 | Hadimioglu et al. | 310/323.01 |
| 5,339,101 A | | 8/1994 | Rawson et al. | 347/46 |
| 5,389,956 A | | 2/1995 | Hadimioglu et al. | 347/12 |
| 5,589,864 A | * | 12/1996 | Hadimioglu | 347/46 |
| 5,594,839 A | * | 1/1997 | Shu | 358/1.9 |
| 5,821,958 A | | 10/1998 | Lim | 347/46 |

* cited by examiner

*Primary Examiner*—John Barlow
*Assistant Examiner*—K. Feggins
(74) *Attorney, Agent, or Firm*—Fay, Sharpe, Fagan, Minnich & McKee, LLP

(57) ABSTRACT

An active controller is provided to control operation of an acoustic printhead in which impedance of the printhead changes with both the active printing row and the distribution of active ejectors in the row. The active controller varies the input power to the printhead in response to active ejectors. Power requirements are insured while also reducing power consumption and maintaining print quality. The determination of RF power is based on the active row, how many ink ejectors are to be switched on, and their position within a row. Look-up tables used to determine proper attenuation or power values are provided in a cascaded fashion.

27 Claims, 6 Drawing Sheets

FIG. 3
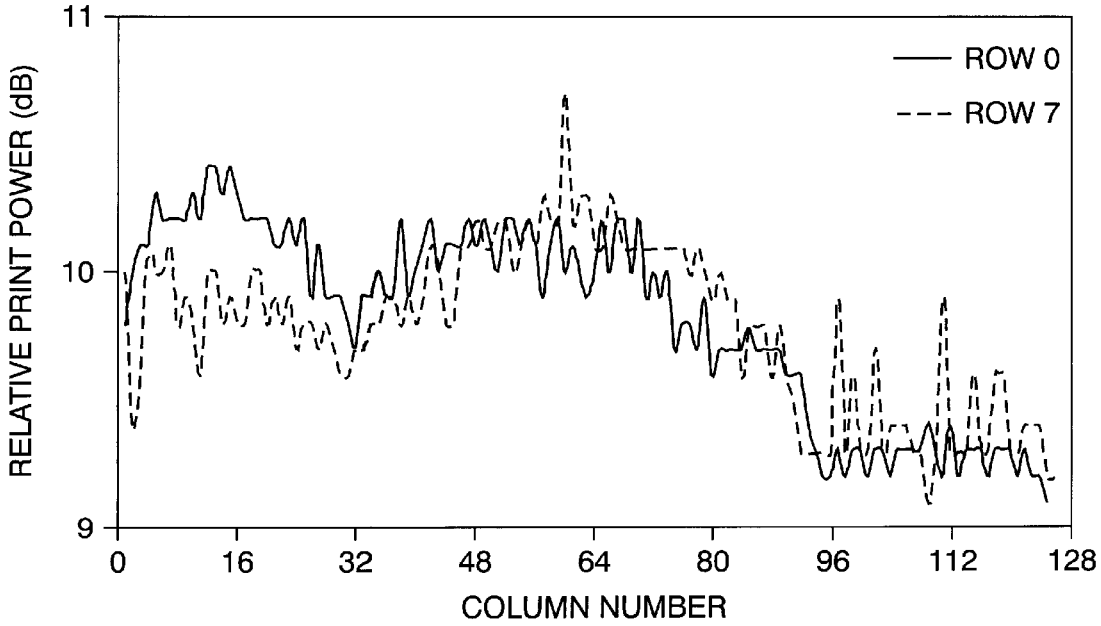
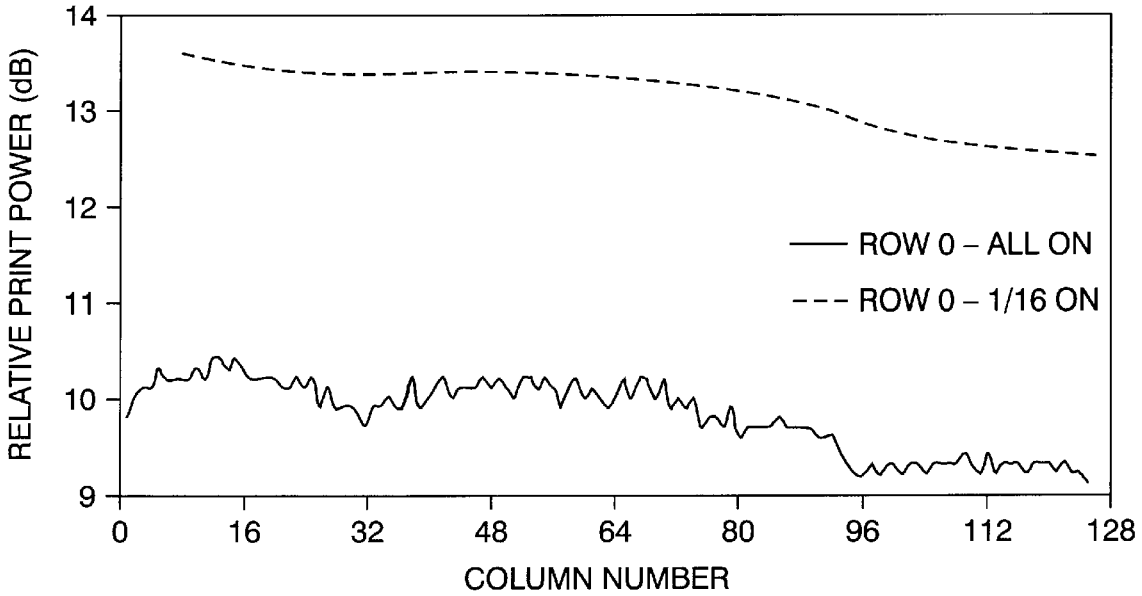
FIG. 4

METHODS AND APPARATUSES FOR OPERATING A VARIABLE IMPEDANCE ACOUSTIC INK PRINTHEAD

BACKGROUND OF THE INVENTION

The present invention relates to an apparatus as and techniques directed to actively determining the power requirements of an acoustic ink printhead and supplying this information to an RF power supply which powers the printhead.

In acoustic ink printing an array of ejectors, forming a printhead, is covered by pools of liquid ink. Each ejector can direct a beam of sound energy against a free surface of the liquid ink. The impinging acoustic beam exerts radiation pressure against the surface of the liquid. When the radiation pressure is sufficiently high, individual droplets are ejected from the liquid surface.

The ejectors may be arranged in an array of rows and columns, with the rows stretching across the width of the recording medium, and the columns of ejectors approximately perpendicular along the movement of the recording media.

Ideally, when each ejector is activated it ejects a droplet identical in size and velocity to the droplets of all the other ejectors in the array. Thus, each ejector should operate under identical conditions.

As may be appreciated, acoustic printing is subject to a number of manufacturing variables including thicknesses and stresses on the ultrasonic transducers, electromagnetic reflections on transmission lines, variations in acoustic coupling efficiencies, and variations in the components associated with each transducer. These variables, if not controlled sufficiently, result in non-uniform droplets, i.e. droplets that vary in size, ejection velocity, and/or other characteristics. Non-uniform droplet size produces undesirable intensity variations in the final image, while non-uniform ejection velocity produces mis-aligned droplets. Non-uniform droplets may degrade the desired output, such as an image, so much that it becomes unacceptable.

Further, even if an acoustic printhead is designed to eliminate negatively impacting manufacturing variables do, control of input power to the printhead may be needed. However, when the manufacturing variables exist, there is less margin for power variability, and therefore, precise power control is desirable. Thus, one manner of improving uniformity in droplet ejection is to ensure that power supplied to a row of ejectors is consistent for each of the ejectors. However, due to manufacturing and other variables the power supplied at one end of a row is known to vary. Therefore, an ejector close to the RF source may receive a higher level of energy than one located distant therefrom.

One proposal to provide balanced power to a row of ink ejectors is by the use of what is known as "dummy" transducers associated with transducers designed to emit a droplet. Under this architecture, the same amount of power is consistently supplied to a row of ejectors. If a particular ejector is not to be activated, the power is passed to the dummy transducer rather than to the transducer which would cause ejection. This arrangement allows for a consistent application of power to a row of ink ejectors, no matter how many ejectors are being fired in a row of the printhead. However, a drawback to this configuration is the amount of area on the printhead necessary for the "dummy" transducers. Additionally, whether one or all ejectors (i.e. 128) are used, 100% power is supplied to the row. This results in wasted energy, and causes an undesirable rise in printhead temperature.

Another design, used to obtain droplet uniformity, is described in U.S. Pat. No. 5,389,956, which provides techniques for improving uniformity by compensating for row-to-row variations in the average droplet uniformity by row-wise control of the electric power applied to the transducers. The power applied to each row is adjusted so as to achieve uniform average droplet characteristics from each row. This technique also uses an impedance matching network to match its input to the impedance of the printhead components.

Another technique described in the above patent is to vary the efficiency of the individual droplet ejectors by physically trimming (such as with a laser) one or more of their associated components. Specifically, this may be accomplished by physically trimming the dimensions of the individual transducers, varactors, one or more resistors, or one or more capacitors. Components may be included in the basic droplet ejector specifically for trimming.

Another technique described in U.S. Pat. No. 5,389,956 is to control the voltage applied to the varactors of droplet ejectors. By adjusting the varactor voltage applied to each column (row) as a function of that column's (row's) average droplet characteristic, uniform average droplets can be produced by each column (row). Alternatively, by controlling the varactor voltage applied to each droplet ejector that is ejecting a droplet, substantially uniform droplets can be achieved from each droplet ejector. Beneficially, the varactor voltages are obtained via digital-to-analog (D/A) converters controlled by memory devices that store the proper codes for the D/A converters to produce their required voltages.

Existing systems therefore use a passive power balancing network, or use static information to vary the amplification (or the attenuation) of the power amplifier and RF driver used to supply energy to the printhead.

Thus, it is considered desirable to provide an active control network which is external to the printhead to determine the amount of energy required for operation of ink ejectors based on the number of ink ejectors which are going to be used by an active row.

SUMMARY OF THE INVENTION

In accordance with the present invention there is provided an apparatuses and techniques to ensure that sufficient power is supplied to an acoustic ink printhead which has variations in impedances during operation, where the impedance variations result due to variations in the number of ejections being used. One manner of ensuring sufficient power is to implement an active controller external to the printhead, which determines an amount of power that is to be supplied to a row of ejectors based on the number of ejectors in an active row which are going to be used. The active controller sends a power supply control signal to the power supply, whereby the power supply control signal determines the amount of power supplied to the row of ink ejectors.

Another aspect of the present invention is generation of a first power supply control signal for a first set of ink ejectors of a row and at least one other power supply control signal for at least one other set of ink ejectors in the same row. The first and at least one other power supply control signals being used in generating an appropriate output signal to the row of ink ejectors when the row is powered.

With attention to yet another aspect of the present invention, the active controller is a forward looking device which makes its determination as to required power for a particular row of ejectors, prior to activation of the ink ejectors for the particular row.

With attention to yet another aspect of the present invention, when a maximum allowable power value is exceeded, an inhibit signal inhibits supplying of power to the printhead, above the stored maximum value.

Turning to yet another aspect of the present invention, the active controller determines where in a row the ink ejectors are to be fired and uses this information in the determination of the amount of power that is to be supplied to the row.

Still yet another aspect of the invention incorporates heat characteristics of the ink ejectors when generating the power control signal.

A principal advantage of the present invention is to ensure a proper supply of power to an active row of ink ejectors to a printhead whose impedance varies, while not requiring 100% output for all instances of ejector activation.

Another advantage of the present invention resides in the elimination of (dummy) transducers, switching elements and associated circuitry to maintain a consistent impedance of the printhead.

Still another advantage of the present invention resides in an active controller, external to the printhead, which increases the accuracy of the amount of power which is required, by determining requirements based on the number of ejectors which are going to be fired. The position of the ejectors which are going to be fired also needs to be taken into consideration.

Still further advantages of the present invention will become apparent to those of ordinary skill in the art upon reading and understanding the following detailed description of the preferred embodiment.

BRIEF DESCRIPTION OF THE DRAWINGS

Other aspects of the present invention will become apparent as the following description proceeds and upon reference to the drawings, in which:

FIG. 3 illustrates attenuation of two rows in a printhead in an "all ejector on" condition;

FIG. 4 illustrates the attenuation in row 0 of FIG. 3 during different ink ejector on conditions;

DETAILED DESCRIPTION OF THE PREFERRED EMBODIMENTS

Figure 1:
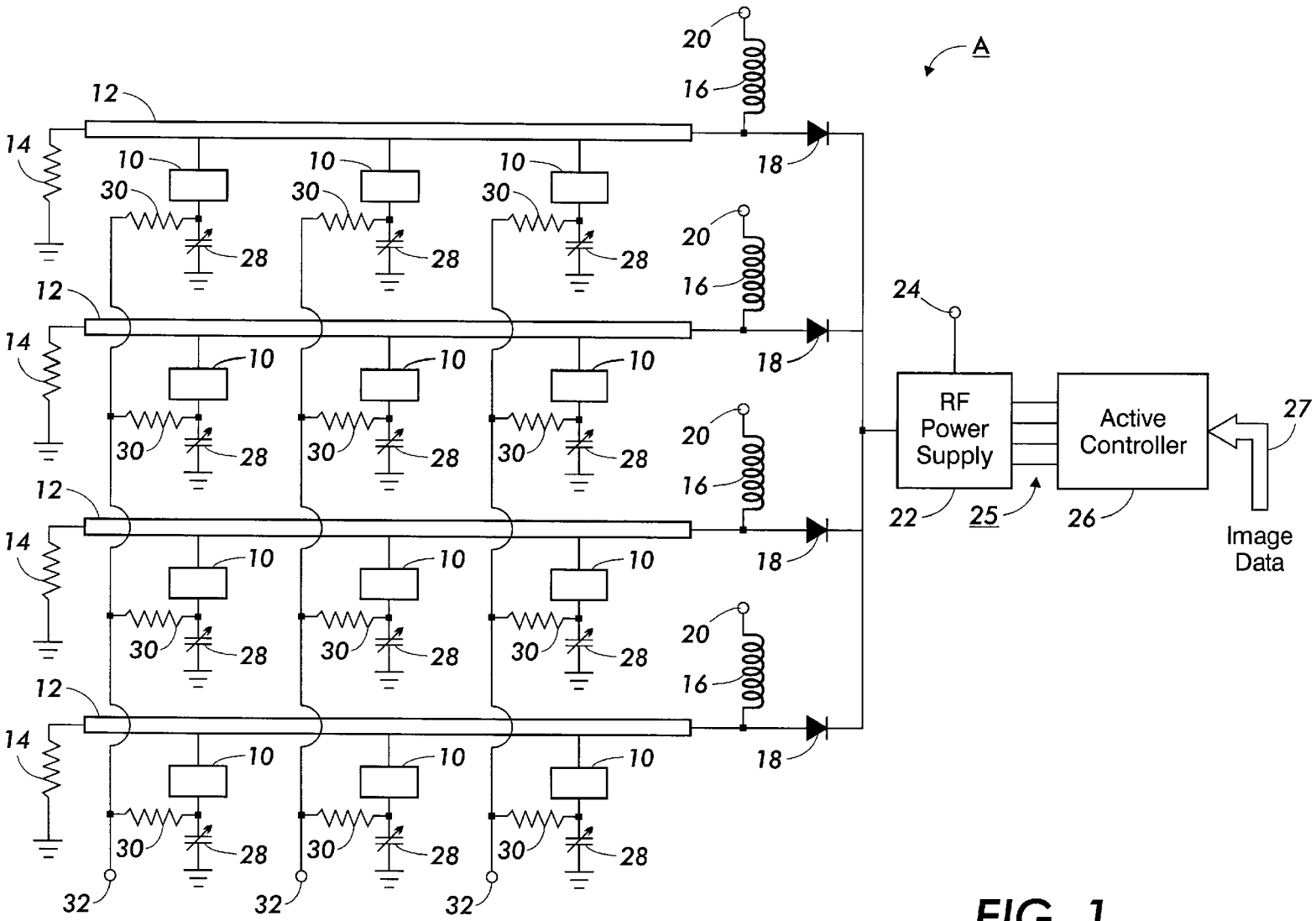
FIG. 1 is a simplified schematic description of a droplet ejector network according to one embodiment of the present invention.

Referring now to FIG. 1, where a simplified schematic depiction of a droplet ejector array network A according to one embodiment of the present invention is shown. The droplet ejector array network A includes a plurality of transducers 10 connected to one of several row conductors 12. Each row conductor terminates at one end with a terminating resistor 14, and at the other end to a row select inductor 16, and to the anode of a PIN diode 18. It is noted that in a preferred embodiment the termination resistors 14 are not needed.

The other terminals 20 of the row select inductors 16, are switchably connected (the switch network not shown for clarity) between a negative voltage (the switched state) and positive voltage (the unswitched state) with respect to the cathode of PIN diodes 18, which are normally reverse-biased. The cathodes of PIN diodes 18 connect to the output of an RF power supply 22. The inputs to RF power supply 22 include an RF input signal, applied on a line 24, and one or more power supply control signals 25 from an active controller 26. The active controller 26 receives image data 27 including data which identifies the row from which a droplet is to be ejected and the location and number of ejectors which are to be fired.

Also, each transducer 10 connects to an associated varactor or similar switching device 28 (shown as a variable capacitor), and a biasing resistor 30. The other terminals of biasing resistors 30 are interconnected into columns addressable by column select lines 32.

To ensure sufficient power is supplied to each row of a printhead, the electric power applied to each row is controlled by active controller 26, by varying the output of RF power supply 22 according to the output of the active controller 26.

Figure 2:
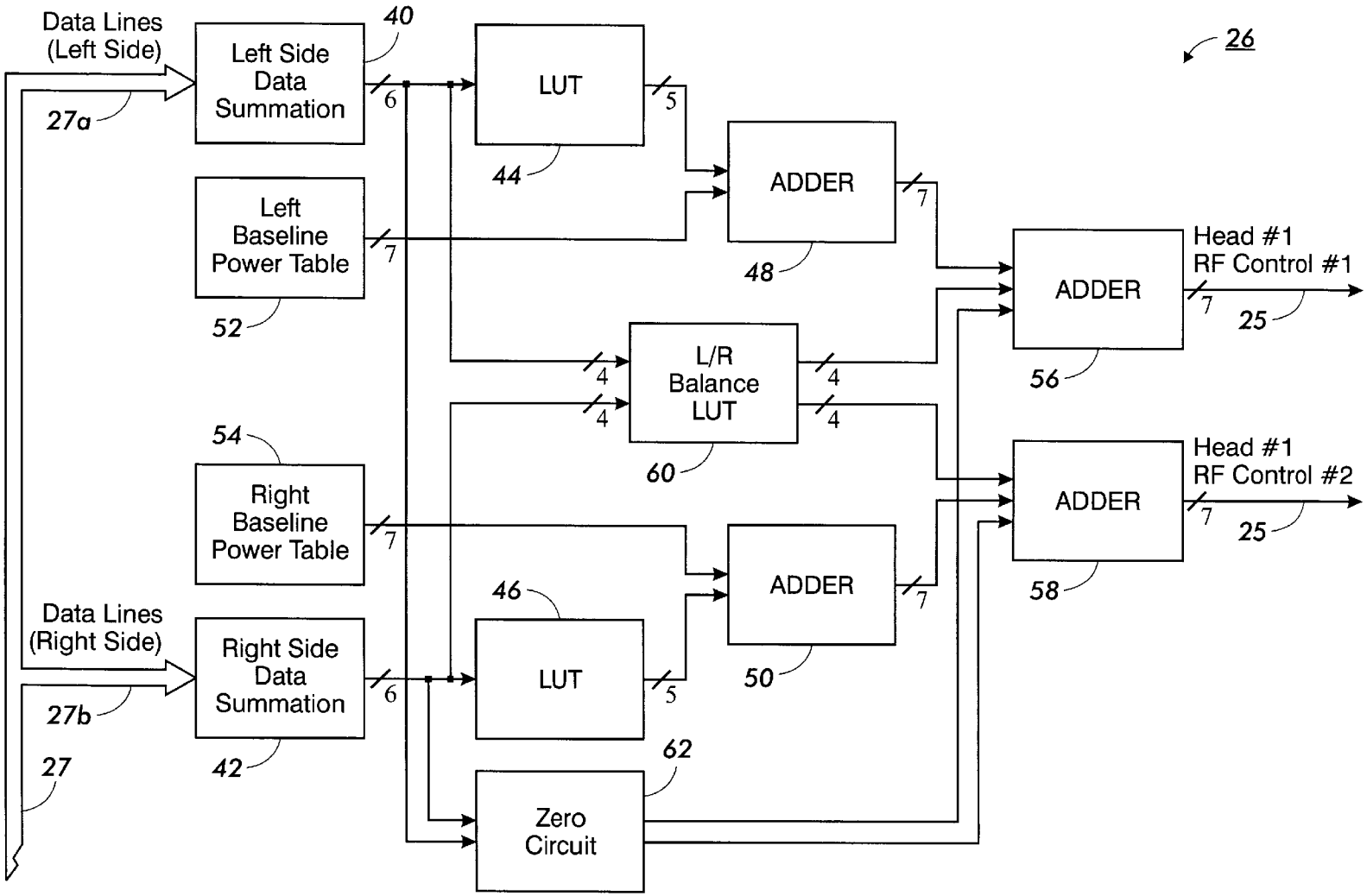
FIG. 2 is an expanded view of an active controller of the present invention.

FIG. 2 provides a more detailed depiction for one embodiment of active controller 26. As shown in this embodiment, image data 27 is divided into left side image data, 27*a*, and right side image data, 27*b*. The left side image data, 27*a*, corresponds to data for ink ejectors on a left side of the printhead, and the right side image data, 27*b*, corresponds to data for ink ejectors on a right side of the printhead. In consideration of a printhead with 8 rows of ink ejectors and 128 ink ejectors in a row, the left side image data is data directed to the left 64 ink ejectors and the right side to the right 64 ink ejectors in each row. The image data includes information as to which row is to be activated, and which ink ejectors in the row to be activated are to generate droplets in correspondence with the received image data. The left side, right side distinctions in the document may also be called first side, second side. Left side image data 27*a* is supplied to a left side summation circuit 40, and right side image data 27*b* is supplied to a right side data summation circuit 42.

As noted, the image data includes which row of a printhead is to be activated at a particular time as well as which ink ejectors in the row are to be fired during this active period. The left side data summation circuit 40 and right side data summation circuit 42 sums the number of ink ejectors which will be fired when the selected row is activated. This information is, respectively, provided to a left side look-up table (LUT) 44 and a right side look-up table (LUT) 46. The respective data received by left side LUT 44 and right side LUT 46 is used to obtain a power value, stored in the LUTs, based on the number of ejectors which are to be fired during the active row time period. The information from left side LUT 44 is then forward to left side adder 48, and the information from right side LUT 46 is forwarded to right side adder 50. Also, input into respective adders 48 and 50 is data from left side baseline power table 52 and right side baseline power table 54.

The foregoing discussion in connection with FIG. 2, has primarily been directed to a situation where the printhead is divided into two sections. However, the concepts of the present invention are not to be so limited. Rather the representation shown in FIG. 2 also teaches that the ejectors in a printhead may be divided into N sections with N being greater than two. With this understanding, the RF output can more generally be described as:

$RF$ output=f{[input data group $A$], [input data group $B$], . . . [input data group $N$]}, where f is frequency of the input signals, and the input data groups A, B, N are the print data for each section of ejectors.

It is to be further appreciated that the RF output may not only be controlled as a function of input data, but the phase of the RF signal may also be controlled.

Each row in a printhead will have different characteristics. For example, as depicted in FIG. 3, the unique characteristics of a row 0 and a row 7 of a particular printhead are illustrated. The asymmetry between the rows can be attributed to many factors, such as differences in RF cable lengths, which cause a phase angle mismatch between the RF power entering from left side and right side power taps. The graphs shown in FIG. 3 illustrate the response of these two rows in the "all ejector on" condition. The left baseline power table 52 and the right baseline power table 54 store these signatures or row profiles, and based thereon deliver selected outputs to the respective adders 48 and 50. Within adders 48 and 50, the power value from respective LUTS 44 and 46 are combined with the power values such as shown in FIG. 3 for each of the left side and the right side.

The output from left side adder 48 is delivered to second left side adder 56 and the output from right side adder 50 is delivered to second right side adder 58. This information is then combined with information from the balance look-up table (LUT) 60. As can be seen, the input to balance LUT 60 is data from left side data summation circuit 40 and right side data summation circuit 42. The balance LUT 60 generates a ratio power value which is supplied respectively to adders 56 and 58. This information provides yet a further refinement of the overall power signals 25 which are forwarded to RF power supply 22 of FIG. 1.

The present invention is designed to supply sufficient attenuation control so as to obtain a desired output. In one embodiment it is estimated that control signals 25 will cause power supply 22 to operate in approximately a 3 dB dynamic range. This is evidenced by the graphs of FIG. 4. For printhead row 0 where only 1 in 16 of the ejectors in row 0 are active, the print power range over the printhead is from approximately 13.5 dB to 12.5 dB. In the graph where all ejectors are on, the power range over the printhead is from 10.5 dB to 9.5 dB or less. Note that the power required for printing only 6.25% of the ink ejectors in a row is more than 3 dB's (approximately 50%) lower than the "all-ejector-on" (bottom line) case. This figure also illustrates that the power required to deliver drops to a desired location on a paper changes with the image being printed. The power supply powers a specific printhead row for a small amount of time, sometimes as short as 2 $\mu$s, and then is multiplexed down to a next row. Therefore, in a 8-row printhead, the system multiplexes through each row, providing power sequentially for a short period of time for each row. In one embodiment the pulse may be 2 $\mu$s . However, it is to be understood that for different materials, the amount of time for the pulse can be longer. For example, a 10–15 $\mu$s pulse is normal for waxy materials.

It is to be appreciated that the present invention is directed to a "look ahead" type system. In particular, the image data 27 being delivered to the respective summation circuits 40,42 are not immediately required for operation of the printhead. Rather, if for example, at a clock cycle 1, the output adders 56 and 58 are outputting data, clock cycles 4, 5 or some other following clock cycle (dependent upon the system buffering), will be entering into summation circuits 40 and 42. By this design, the present invention provides the printer with information that in a few clock cycles, the printer is going to need, i.e. the number of ink ejectors of a certain row which is to be moved to an active state. The system uses this information to set a power level so the appropriate amount of power (when the switching system multiplexes back to the relevant row) will be available for the row.

The present invention makes it possible to deliver only the power required to fire the ejectors which have been indicated as necessary. This means that 100% of the RF power is not always required. Providing this active control increases savings and precision of the power delivered to a row. While, under the present scenario, even to fire a single ejector might require approximately 50% of the RF power, it does not require the 100% of previous systems. Thus, the present invention also saves on power consumption.

The right side and left side of the system operate in a parallel stepping manner, which allows both sides to step through their processing of image data for the same ejector row. This is a valuable feature since if the data is not processed in such a manner, data for the same row (from the different sides) could arrive at adders 56, 58 at different times. This would mean data from one side would be used for one row while the data arriving at another time would be used in conjunction with another row. Such an outcome would be undesirable.

In existing ink printer systems, it is known to use four printheads (i.e. CMYK). Commonly, some of these printheads will be off a printing area while the others are printing. There will only be a short period of time when all four printheads would be printing onto a substrate. This is the time period when the highest power supply stresses occur.

The printer may be designed with parameters which ensure the power supply is capable of meeting all power requirements during this high stress time period. However, it is desirable to minimize the physical dimensions of the acoustic ink printer. One aspect in which this minimization can be achieved is by using a smaller power supply. Using the concepts of the present invention it is possible to design active controller 26, to allow use of a power supply having a peak capacity less than would be required to ensure proper printing during a high stress time.

For example, if it is understood all four printheads operating at the same time require a power "X", but the design parameters have a power supply with a capacity of "X–1", the active controller 26 may be used to ensure proper operation. Specifically, a maximum output power value can be input into various ones of the active controller components to generate an inhibit signal which does not allow the printing to occur if it is determined that such printing would require greater than "X–1" power output. This is possible since the system has already added up the power that a particular printhead will need. So the system can indicate that the required power is more than the predetermined value. Under this scenario the power control signals 25 would be inhibit signals. Additional passes of the printhead are undertaken during a less power-stress time period to complete the output image.

The maximum output power value may be stored in the adders 56 or 58, and a simple comparison operation undertaken to determine if an inhibit signal needs to be issued.

Alternatively, the maximum output power value may be stored in one of LUTs 44 or 46 as a value representing a maximum number of ejectors which may be fired. Then a simple comparison operation determines if an inhibit signal is to be issued. Of course, in the four printhead system, a design may be incorporated which adds all requirements of each printhead prior to allowing the power to be supplied. It will be necessary, in this embodiment of the system, to look at the sum of adders 56, 58 for all colors.

In addition to summation circuits 40 and 42 looking at the number of ink droplets which are to be used when a row is activated, the power control signals may also be designed to take into consideration other variables, such as when the ejectors were last fired. This information is valuable as it is known that a recently fired ink ejector requires less energy than an ink ejector which has not been fired for a substantial time period. This information can therefore be used to further refine the value of power control signals 25.

In a similar vein, it is known the temperature from end to end of a printhead can have variations. This information can also be supplied via image data 27 to summation circuits 40,42 and incorporated into the generation of power control signals 25.

As previously noted, in situations where even a single ejector is to be fired in an active row, approximately 50% of the RF power will be used. Therefore in a special case where no ink ejectors are to generate droplets during an active row, a zero signal is generated by the left side data summation circuit 40 and right side data summation circuit 42 and delivered to zero output circuit 62. This information is passed to adders 56 and 58 which generate an off signal for the RF power supply 22.

Figure 5:
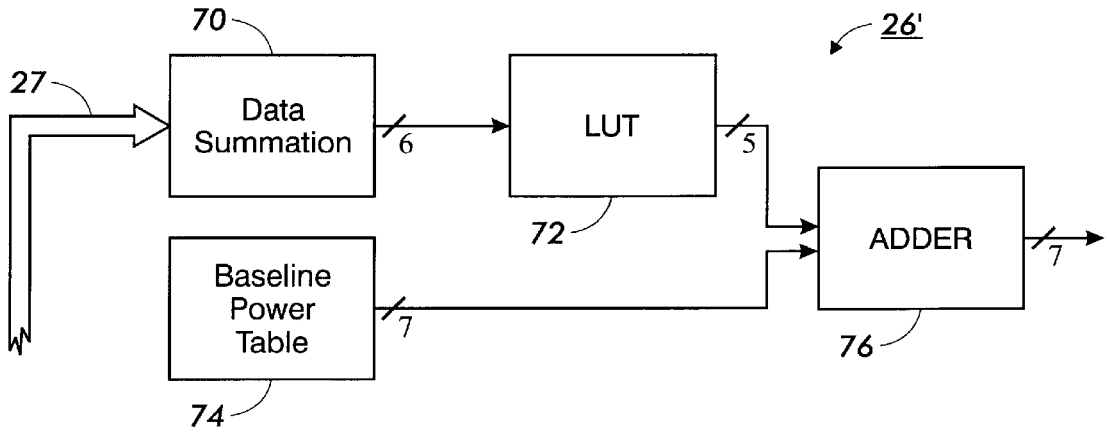
FIG. 5 illustrates a second embodiment of the active controller of the present invention.

Turning to FIG. 5, shown is a second embodiment of the active controller 26'. In this embodiment, the left side and right side distinctions, as well as the balance LUT 60 are not required.

It is to be appreciated the embodiment of FIG. 2 includes the left side/right side distinctions due to inconsistent characteristics which exist over the length of the printhead. Particularly, it is known that from one end to the other end different phase angles may exist from end to end of a printhead, causing non-equal distribution of power between the left and right sides. Such imbalances are illustrated in FIG. 4. Due to this, it is at times desirable to tune these sides separately rather than just looking at an overall level.

The variations in phase angle and therefore the non-uniformity over the length of the row generally exist due to manufacturing variables which are not sufficiently controlled to provide a uniform distribution of power. However, improvement in manufacturing tolerances causes instability of the printhead from the left side to the right side to be diminished.

Under this scenario, the benefits of power control previously described may be obtained using the design shown in FIG. 3, where data summation circuit 70 receives image data 27 and determines the number of ink ejectors which will be turned on in an entire row that is to be active. This information is then provided directly to look-up table 72, which matches the input information to a corresponding attenuation value. Still used is baseline power table 74 which has stored therein profiles and characteristics of each row of the printhead. This information is then forwarded to adder 76, where it is combined with the information from LUT 72 and baseline power table 74. Adder 76 outputs the required attenuation value represented by power control signals 25.

As previously mentioned, baseline power table 74 (as well as the left and right baseline power tables 52 and 54 of FIG. 2) include profiles or characteristics for each row of the printhead. This information is obtained by a scanning system, which during testing measures the characteristics of droplets the printer generates. These patterns are analyzed, and when a droplet occurs within a predetermined ring of a desired area, the scanner records this as a successfully delivered droplet. From this information a graph is drawn indicating the output characteristics of a particular row. The information records that for different amounts of ink ejectors which will be activated, different characteristics of the particular row are apparent. It is also to be noted that zero signal circuit 62 of FIG. 2 may also be implemented in the embodiment shown in FIG. 5, though not shown.

Data used to describe the characteristics of each printhead will be of a fairly small amount. This allows for easy parameterization of the information into a compact concise data format. One way of identifying characteristics of a particular printhead is to include it as part of a serial number of the printhead so when a user or technician is changing the printhead in the field, the printhead serial number would indicate various characteristics of that printhead which could be used in adjusting the machine, etc. Other manners of carrying the characteristics of a particular printhead with that printhead would be through software of the machine, a ROM on the printhead, or by a bar coding the information.

Figure 6:
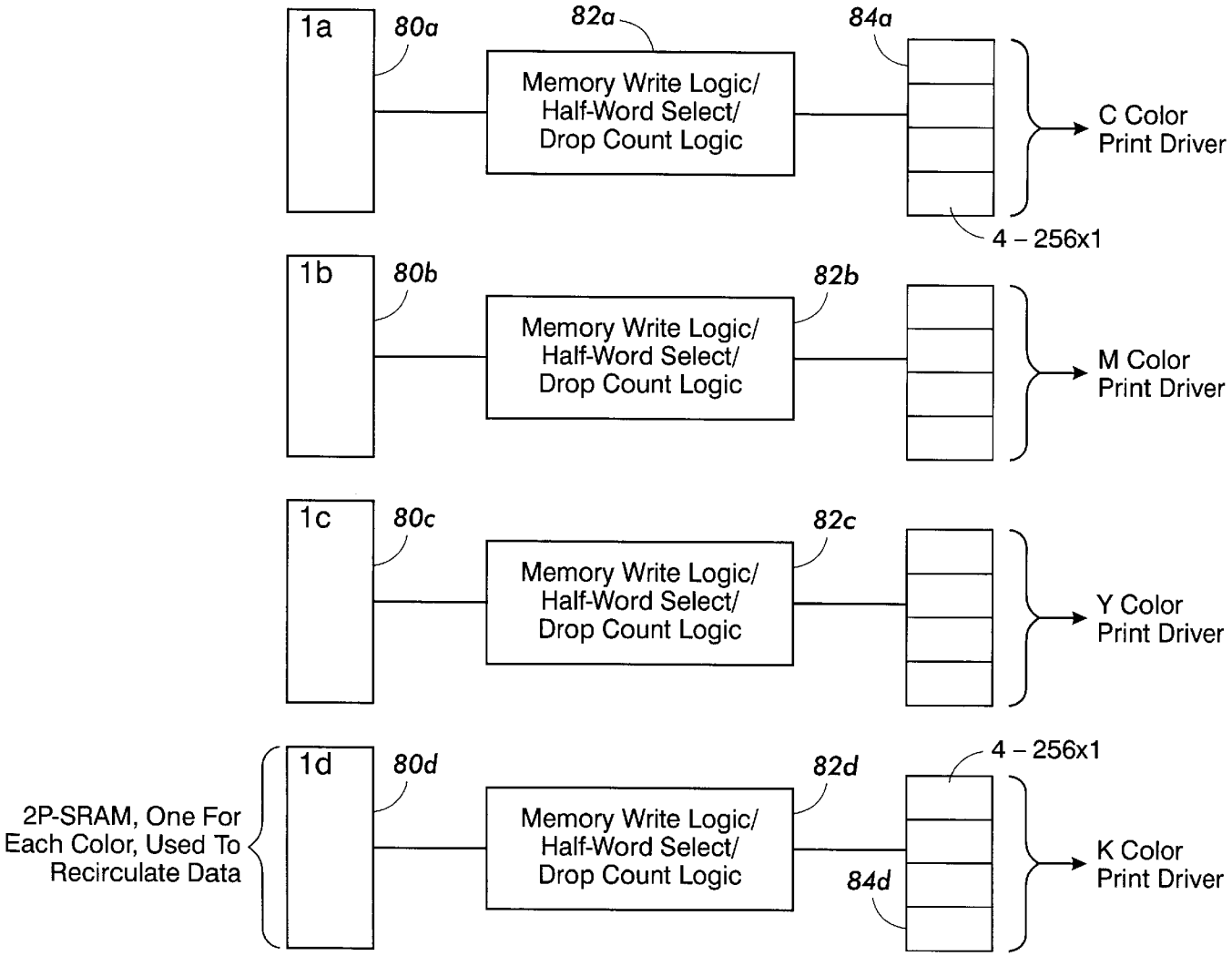
FIG. 6 (PRIOR ART)
FIG. 6 illustrates a conventional manner of generating multiple drops per pixel.

Turning to FIG. 6, shown is a conventional arrangement for generating multiple drops per pixel. As is known in acoustic printing, it is possible to generate very small droplets. Therefore, to fully print a pixel, it may be necessary to generate multiple drops per pixel.

In FIG. 6, a 2P-SRAM 80*a*–80*d* is provided for each color (i.e. CMYK) and used to recirculate data. The data from each 2-port SRAM would be delivered to blocks 82*a*–82*d* which include drop count logic. Data from blocks 82*a*–82*d* are then passed to linear look-up tables 84*a*–84*d* for each of the colors CMYK. Thus, the look-up tables of the previous embodiment use large linear single look-up tables implemented in a cyclical fashion.

Figure 7:
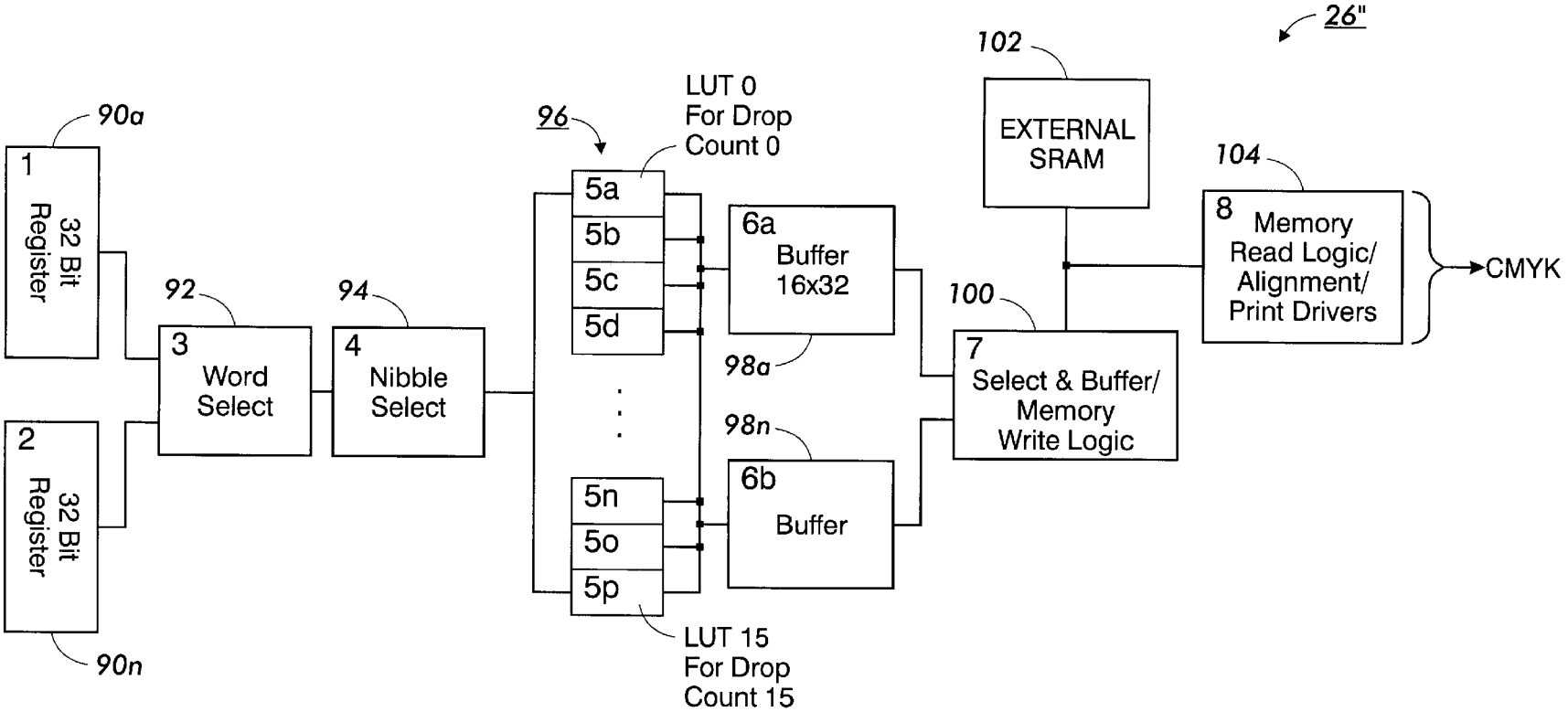
FIG. 7 illustrates a configuration for multiple drop generation in accordance with the present invention.

In connection with a further aspect of the present invention, and as shown in FIG. 7, detailed is a multiple drop system which may be implemented as a third active controller 26" embodiment. In this design, 32 bit registers 90*a*–90*n* provide data to a word select block 92 which in turn selects data and forwards the data to a nibble select block 94. A look-up block 96 includes look-up tables LUT O-LUT 15 which provide information to buffers 98*a*–98*n*. Information from buffers 98*a*–98*n* are provided to a select and buffer/memory write logic circuit 100. Data from circuit 100 is provided to an external SRAM 102 and also to a memory read logic/alignment/print driver block 104. Output from block 104 is provided to printheads CMYK.

For operation with a 4-bit pixel, in a first step, (a) four words are loaded from CMYK colors successively; next (b) from each 4-bits of color C, 16 pixels are generated for all drop counts (e.g. from 0 through 15) (resulting in an outcome equal to 512 pixels); then (c) these pixels are packed with the same drop count and stored into an external SRAM block 102.

Thereafter, (d) steps b and c are repeated for each of the colors M, Y and K. Next, steps a–d are repeated until the end of an image is completed. In a situation of a 2-bit pixel, two words are loaded from CMYK colors successively and steps a, b, c and d are then undertaken.

Using the concepts of FIG. 7, in the printer of the present invention, a single LUT can be used to reference into another LUT. At a first level, is a drop-level count and at a second level is a row-level count. Therefore as shown in FIG. 7, there is a LUT 0 with a drop count of 0 running down to a LUT 15 for a drop count 15. This implementation divides the pre-existing linear LUTs into cascaded LUTs. By this operation, input data is stored in buffers 90*a*–90*n* and are successively unloaded. These 32 bits of data are then broken into 4-bit pixels, and for ejection of droplets. The number of droplets will depend on the number of droplets which are used to form a pixel.

A 4-bit pixel selected from the input word image is converted into 16 different droplets at the same time. This is accomplished by sending the same pixel information to 16 different LUTs (LUT 0–LUT 15) and the existence of different drop counts. Stored in the temporary registers 98*a*–98*n* are 16 output pixels (droplets) from LUTs (LUT 0–LUT 15), which are aligned with the droplets from an adjacent pixel, and finally the pixels are stored into an external memory 102 for downloading onto the printhead upon request.

By use of the present invention, no re-circulation buffer is needed, allowing for a low-cost system, and the data transfer rate will be higher than compared to a conventional architecture. For example, looking at data from a re-circulation buffer (2-port ram) of a conventional architecture, 8 pixels (from a 32-bit word) are unloaded and processed. On the other hand, in the presently described architecture, external memories deliver at least 32 pixels at every other clock.

It is to be noted that the preceding discussion discussed the use of acoustic ink printers for the expulsion of ink droplets. It is, however, to be understood that the concepts of acoustic ink printing may be implemented in other environments other than 2-dimensional image reproduction. Such uses may include the generation of 3-dimensional images by droplet application, the provision of soldering, transmission of medicine, and other fluids.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

Having thus described the present invention it is now claimed:

1. An acoustic ink printer comprising:

an acoustic ink printhead having a matrix of ink ejectors arranged in rows and columns, each ink ejector associated with a particular row and column of the matrix, the printhead having a variable impedance between rows and across a single row;

a plurality of row switches, each of the row switches connected to a corresponding row;

a plurality of column switches, each of the column switches connected to a corresponding column;

a power supply in operational connection to at least one of the row switches and column switches to selectively supply a power supply signal to selected ones of the row switches and the column switches, in order to move the row switches and column switches between on and off states and wherein the power supply, supplies power to selected rows of ink ejectors for a time period dependent upon a viscosity of the ink being used; and an active controller, external to the printhead, which determines an amount of power which is to be supplied to a row of ink ejectors based on how many ink ejectors in the row are going to be fired, the active controller transmitting a power supply control signal to the power supply, wherein the power control signal determines the amount of power to be sent to at least one of the rows of ink ejectors.

2. The printer according to claim 1 wherein the active controller includes a summing circuit which receives image data, and from the image data sums the number of ink ejectors which are to be turned on to produce ink droplets to generate the received image data on a substrate.

3. The printer according to claim 1 wherein the active controller includes, a first summing circuit, designed to receive first image data of the image data and to sum up a number of ink ejectors which will be used to generate a first image; and a second summing circuit, designed to receive second image data of the image data and to sum up a number of ink ejectors which will be used to generate a second image;

a first look-up table in operational connection with the first summing circuit, the first look-up table receiving information as to the number of ink ejectors which are to be used to generate the first image, and based on the number of ink ejectors to be used, a corresponding value in the first lookup table is selected;

a second look-up table in operational connection with the second summing circuit, the second look-up table receiving information as to the number of ink ejectors which are to be used to generate the second image and based on the number of ink ejectors to be used, a corresponding value in the second look-up table is selected;

a first baseline power table which stores baseline characteristic data of a first side of each of the rows of ink ejectors of the printhead;

a second baseline power table which holds baseline characteristic data of a second side of each of the rows of ink ejectors of the printhead;

a first side adder in operational connection with the first side look-up table and the first side baseline power table, the first side adder receives and processes information from the first side look-up table and the first side baseline power table;

a second side adder in operational connection with the second side look-up table and the second side baseline power table, the second side adder receives and processes information from the second side look-up table and the second side baseline power table;

a second first side adder in operational connection with the first side adder and the balancing circuit, the second first side adder generating a first side power supply control signal to be supplied to the power supply; and a second side adder in operational connection with the second side adder and the balancing circuit, the second side adder generating a second side power supply control signal to be supplied to the power supply, wherein the first side power supply control signal and the second side power supply control signal are capable of generating unique power supply control signals each time a row of ink ejectors are activated.

4. The printer according to claim 3 further including, a balancing circuit, in operational connection with the outputs of the first side summing circuit and the second side summing circuit, the balancing circuit comparing the number of ejectors to be turned on in the first side of the row of printheads and the number of ejectors to be turned on in the second side of the row of printheads, and generating correction data based on this information.

5. The printer according to claim 4 wherein the look-up table is configured of cascaded look-up table portions, the first look-up table portion corresponding to a selected row, and the second look-up table portion corresponding to a specific ink ejector.

6. The printer according to claim 3 wherein the look-up table is configured of cascaded look-up table portions, the first look-up table portion corresponding to a selected row, and the second look-up table portion corresponding to a specific ink ejector.

7. The printer according to claim 1 wherein the active controller includes, a summing circuit, designed to receive image data and to sum up a number of ink ejectors which will be used to generate an image based on the image data;

a look-up table in operational connection with the summing circuit, the look-up table receiving information as to the number of ink ejectors which are to be used to generate the image, and based on the information a corresponding value in the first lookup table is selected;

a baseline power table which stores baseline characteristic data for each row of ink ejectors of the printhead; and an adder in operational connection with the look-up table and the baseline power table, the adder receives and processes information from the look-up table and the baseline power table and generates a power supply control signal which is supplied to the power supply.

8. The printer according to claim 1 wherein the active controller also determines a location in a row where the ink ejectors are to be active, and uses this information in the determination of the amount of power that is to be supplied to the row.

9. The printer according to claim 1 wherein the active controller is a forward looking device which makes its determination as to power required for a particular row of ejectors prior to actual activation of the ink ejectors in the particular row.

10. The printer according to claim 1 wherein the active controller incorporates heat characteristics of the ink ejectors when generating the power control signal.

11. The printer according to claim 1 wherein the active controller includes, a maximum power value which the power supply is permitted to send to the printhead; and an inhibiting signal generated when the maximum power value is equaled or exceeded, and which inhibits generation of power to the printhead above the maximum power value.

12. The acoustic ink printer according to claim 1 wherein the ink ejectors eject droplets to form at least one of 2-dimensional images or 3-dimensional images.

13. The acoustic ink printer according to claim 1 wherein the ink ejectors are configured to eject fluids including at least one of ink, solder or medicine.

14. A method of controlling printing in an acoustic ink printer using an acoustic ink printhead having a plurality of individual ink ejectors arranged in a number of columns and rows, the method comprising:

supplying image data to a summing circuit;

summing up a number of ink ejectors which are to be used to print the image data, the number of ink ejectors to be used being determined from the image data;

supplying the summed up number of ink ejector information to a look-up table in operational connection with the summing circuit, wherein the ink ejector information corresponds to a value stored in the look-up table;

storing baseline characteristic data for each of the rows of ink ejectors of the printhead, in a baseline power table;

adding the characteristic data in the baseline power table to the value in the look-up table corresponding to the ink ejector information to obtain a power supply control signal attenuation value; and controlling the power supplied to the selected row using the power supply control signal.

15. The method according to claim 14 further including determining locations of ink ejectors which are to be fired in a row, and using this information to generate the power supply control signal.

16. The method according to claim 14 wherein the step of summing up a number of ink ejectors which are to be used to print the image data, occurs prior to firing of the ink ejectors.

17. The method according to claim 14 wherein the ink ejectors eject droplets to form at least one of 2-dimensional images or 3-dimensional images.

18. The method according to claim 14 wherein the ink ejectors are configured to eject fluids including at least one of ink, solder or medicine.

19. A method of controlling printing in an acoustic ink printer assembly using an acoustic ink printhead having a plurality of individual ink ejectors arranged in a number of columns and rows, the method comprising:

supplying first image data to a first summing circuit;

supplying second image data to a second summing circuit;

summing up a number of ink ejectors on a first side of the printhead which are to be used to print the first image data, the number of ink ejectors to be used being determined from the first image data;

summing up a number of ink ejectors on a second side of the printhead which are to be used to print the second image data, the number of ink ejectors to be used being determined from the second image data;

supplying the first summed up number of the first side ink ejector information to a first side look-up table in operational connection with the first summing circuit, wherein the first side ink ejector information corresponds to a value stored in the first side look-up table;

supplying the second summed up number of the second side ink ejector information to a second side look-up table in operational connection with the second summing circuit, wherein the second side ink ejector information corresponds to a value stored in the second side look-up table;

storing first side baseline characteristic data for each of first sides of the rows of ink ejectors of the printhead, in a first side baseline power table;

storing second side baseline characteristic data for each of second sides of the rows of ink ejectors of the printhead, in a second side baseline power table;

adding the first side baseline characteristic data in the first side baseline power table to the value in the first side look-up table corresponding to the ink ejector information to obtain a first side power supply output attenuation value;

adding the second side baseline characteristic data in the second side baseline power table to the value in the second side look-up table corresponding to the ink ejector information to obtain a second side power supply output attenuation value; and generating a first side power supply control signal to be supplied to the power supply, using a second first side adder in operational connection with the first side adder and the balancing circuit;

generating a second side power supply control signal to be supplied to the power supply, using a second side adder in operational connection with the second side adder and the balancing circuit; and controlling the power supplied to the selected row using the first side and second side power supply control signal.

20. The method according to claim 19 further including a step of, comparing the number of ejectors to be turned on in the first side and the number of ejectors to be turned on in the second side, and generating a balancing value based on this information, using a balancing circuit, in operational connection with outputs of the first side summing circuit and the second side summing circuit.

21. The method according to claim 19 further including determining locations of ink ejectors which are to be fired in a row and using this information to generate the power supply control signal.

22. The method according to claim 19 wherein the steps of summing the first side of ink ejectors and summing the second side of ink ejectors occurs prior to firing of the ink ejectors.

23. A method of controlling printing in an acoustic-ink printer, using a printhead with a plurality of rows of ejectors:

(a) selecting words representing image data having a plurality of colors;

(b) loading, successively, the words for each of the plurality of colors in a first storage device;

(c) generating from each v-bit of one of the words representing a first color, w-pixels for all drop counts from x-y, whereby a total of z-pixels are formed;

(d) packing pixels, of the total z-pixels with a same drop count together;

(e) storing the packed pixels with the same drop count into a second storage device;

(f) repeating steps (b)–(e) for remaining colors of the image data;

(g) repeating steps (a)–(f) until all image data is processed.

24. The method according to claim 23, wherein each word of the plurality of words is equal to one of 4 words and 2 words.

25. The method according to claim 23 wherein when the v-bit pixel is selected from the input image, the image data is converted into a plurality of droplets at the same time.

26. The method according to claim 25 wherein the first storage device is a plurality of LUTs, and the plurality of droplets are obtained by sending the same pixel to multiple LUTs.

27. An acoustic printer comprising:

an acoustic printhead having a matrix of ejectors arranged in rows and columns, each ejector associated with a particular row and column of the matrix, the printhead having a variable impedance between rows and across a single row;

a plurality of row switches, each of the row switches connected to a corresponding row;

a plurality of column switches, each of the column switches connected to a corresponding column;

a power supply in operational connection to at least one of the row switches and column switches to selectively supply a power supply signal to selected ones of the row switches and the column switches, in order to move the row switches and column switches between on and off states; and an active controller, external to the printhead, which determines an amount of power which is to be supplied to a row of ejectors based on how many ejectors in the row are going to be fired, the active controller transmitting a power supply control signal to the power supply, wherein the power control signal determines the amount of power to be sent to at least one of the rows of ejectors, and wherein the active controller is a forward looking device which makes a determination as to power required for a particular row of ejectors prior to actual activation of the ejectors in the particular row.

* * * * *